US009675106B2

(12) United States Patent
Barry, Jr.

(10) Patent No.: US 9,675,106 B2
(45) Date of Patent: Jun. 13, 2017

(54) APPARATUSES FOR SMOKING FROM A GLOVE

(71) Applicant: TSG Innovations Ltd, Denver, CO (US)

(72) Inventor: Edward M. Barry, Jr., Denver, CO (US)

(73) Assignee: TSG INNOVATIONS LTD, Denver, CO (US)

( * ) Notice: Subject to any disclaimer, the term of this patent is extended or adjusted under 35 U.S.C. 154(b) by 982 days.

(21) Appl. No.: 13/960,707

(22) Filed: Aug. 6, 2013

(65) Prior Publication Data

US 2014/0053854 A1 Feb. 27, 2014

Related U.S. Application Data

(60) Provisional application No. 61/680,091, filed on Aug. 6, 2012.

(51) Int. Cl.

| | |
|---|---|
| ***A24F 3/00*** | (2006.01) |
| ***A24F 47/00*** | (2006.01) |
| *A41D 19/00* | (2006.01) |

(52) U.S. Cl.
CPC ..... *A24F 47/00* (2013.01); *A41D 19/0024* (2013.01)

(58) Field of Classification Search
None
See application file for complete search history.

(56) References Cited

U.S. PATENT DOCUMENTS 5,680,654 A * 10/1997 McClanahan, II . A41D 19/0017 2/159

* cited by examiner

*Primary Examiner* — Phu Nguyen
(74) *Attorney, Agent, or Firm* — Lathrop & Gage LLP

(57) ABSTRACT

A smoking glove includes a glove having a first opening and a second opening, the first opening located at a finger portion of the glove. The second opening is distal from the first opening at a distance of at least half a length of the finger portion of the glove. The smoking glove includes tubing, the tubing stretching from the first opening of the glove to the second opening of the glove. The tubing is located within the glove. The smoking glove includes a bowl located at a first end of the tubing.

19 Claims, 2 Drawing Sheets

APPARATUSES FOR SMOKING FROM A GLOVE

CROSS-REFERENCE TO RELATED APPLICATION

This application claims the benefit of U.S. Provisional Application No. 61/680,091 filed Aug. 6, 2012, which is incorporated by reference to the same extent as though fully contained herein.

BACKGROUND OF THE INVENTION

When smoking in a cold weather environment, many problems can arise due to cold temperatures, moisture, wind, and other outdoor elements. High winds not only make it difficult to light tobacco, but they also increase the risk for frostbite. Cold weather environments can induce frostbite and/or hypothermia if proper attire is not worn to protect bare skin from the elements. In order to smoke, a person would have to take off a layer of clothing, gloves for example, exposing bare skin to a hazardous winter climate in order to smoke.

The Smoking Glove gives the ability to smoke without taking off gloves and exposing bare skin to the elements. The flap coving the bowl also cuts down on wind making it much easier for the consumer to light the bowl. There is a vast market for winter apparel such as gloves and a vast number of people who smoke and are looking for easy, efficient ways to smoke in winter activities, i.e., on the mountain while skiing.

SUMMARY

In one embodiment, a smoking glove includes a glove having a first opening and a second opening, the first opening located at a finger portion of the glove. The second opening is distal from the first opening at a distance of at least half a length of the finger portion of the glove. The smoking glove includes tubing, the tubing stretching from the first opening of the glove to the second opening of the glove. The tubing is located within the glove. The smoking glove includes a bowl located at a first end of the tubing. Optionally, the first opening is at an end of the finger portion, distal from a palm of the glove. In one configuration, the second opening is at a back of a hand portion of the glove. In one alternative, the smoking glove includes a first flap and a second flap, the first and second flaps attached to the glove and located at the first and second openings, respectively, and configured to provide for closure of the first and second openings. Optionally, a portion of each of the first and second flaps has a closure mechanism to secure the closure of the first and second openings. Alternatively, the closure mechanism is Velcro. In another configuration, a mouth piece is located at a second end of the tubing. Optionally, the smoking glove includes a plug, the plug attached to the first flap and sized to fit into the bowl for sealing the bowl when it is not in use. Alternatively, the first opening is at an end of the finger portion, distal from a palm of the glove; and the second opening is at a back of a hand portion of the glove. Optionally, the bowl is located at the first opening. In another alternative, the bowl is located at the second opening. Optionally, at least a portion of the glove is made of flame-resistant material. In another configuration, the glove includes a liner and an outer portion, and the tubing is located between the liner and the outer portion. Optionally, fire-resistant insulation is positioned proximate to the bowl and tubing.

In another embodiment, a smoking glove includes a glove having a first opening and a second opening, the second opening distal from the first opening at a distance, the distance being at least two inches. The smoking glove includes tubing, the tubing stretching from the first opening of the glove to the second opening of the glove. The tubing is located within the glove. The smoking glove includes a bowl located at a first end of the tubing. In one configuration, the first opening is in a finger of the glove. Optionally, the first opening is in a back of a hand area of the glove. In another configuration, the second opening is in a back of a hand area of the glove. Optionally, the second opening is in a finger of the glove.

DETAILED DESCRIPTION

Figure 1A:
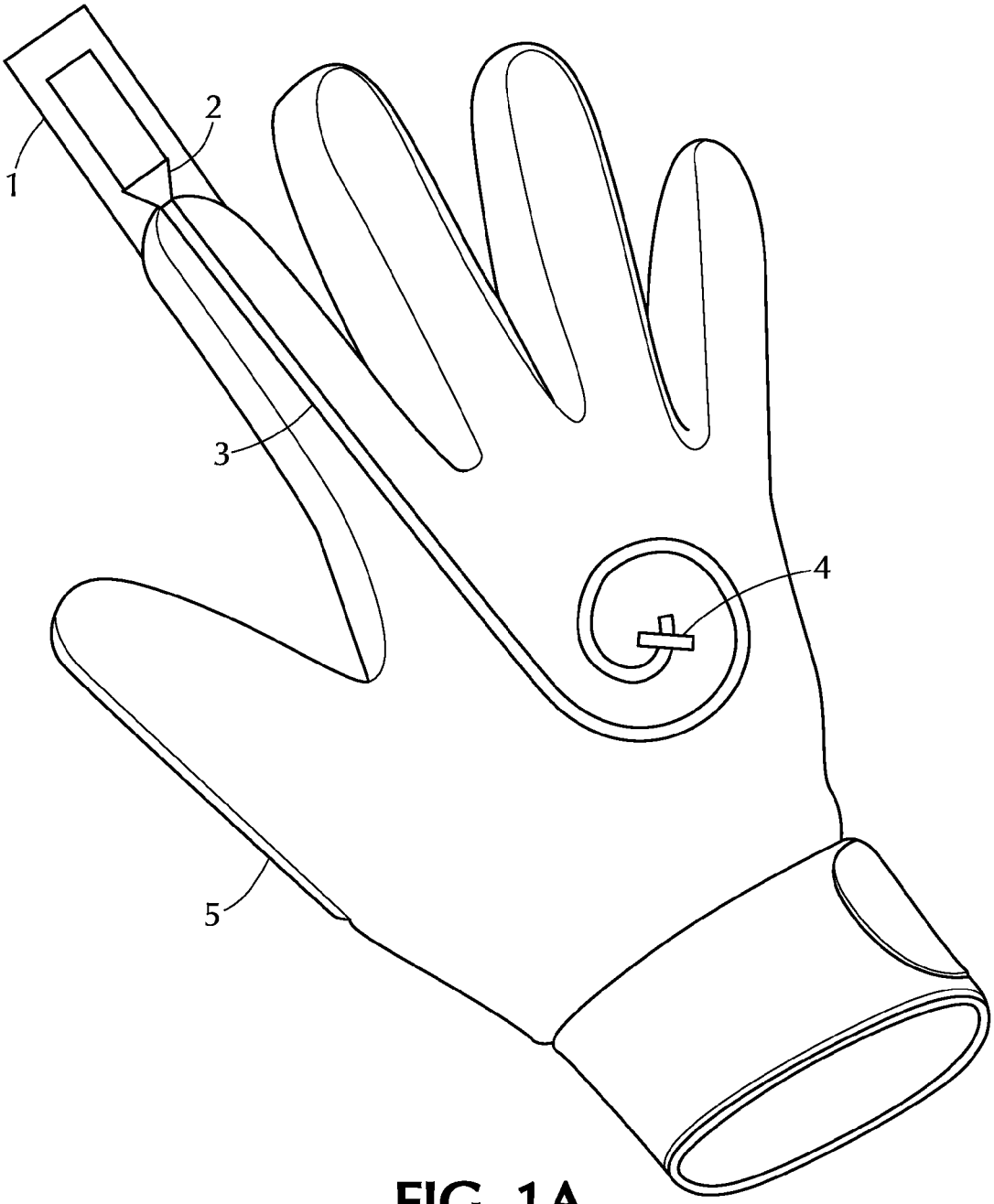
FIG. 1A shows a first cutaway view of one embodiment of a smoking glove.
Figure 1B:
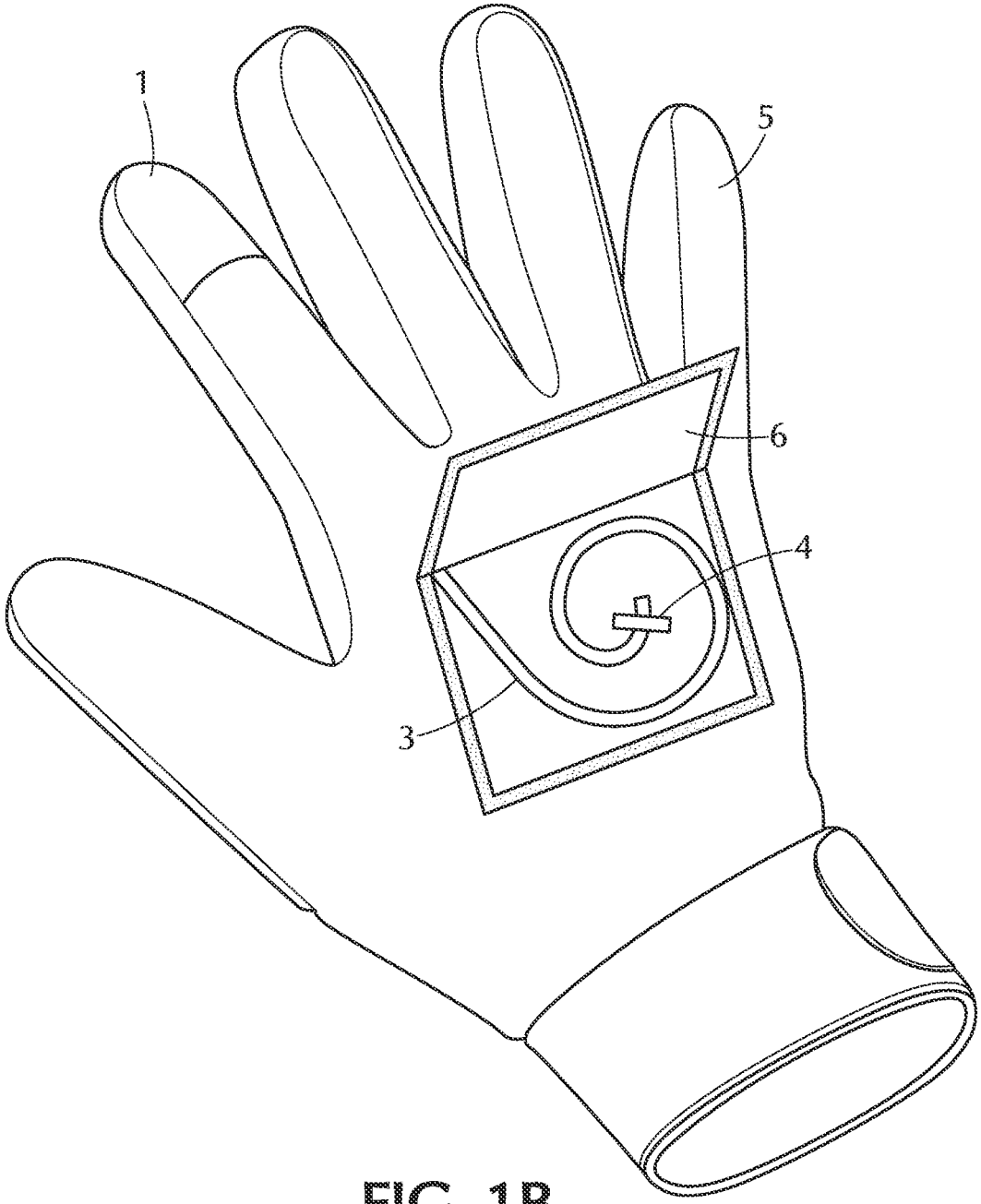
FIG. 1B shows a second view of one embodiment of a smoking glove.

In one embodiment, the smoking glove 5 is assembled according to a number of steps. A normal ski glove may be used as the starting point for a smoking glove 5. One slit may be cut on the top of the index finger portion of the glove 5 (left and/or right index finger on glove 5). Then another slit may be cut in the lining that is inside the pocket located on the back of the hand. A flap 6 of fabric may be left, or alternatively a flap may be sewn onto the glove 5. Then tubing 3 is inserted through the slit in the lining of the pocket located on the back of the glove 5, and the tubing 3 is run up the index finger between the inner layer and outer layer of the glove 5 and out of the slit made in the top of the index finger. In some embodiments, the tubing 3 may be specially insulated with a protective layer that reflects heat away from the glove 5 material to prevent melting or burning. The tubing 3 material may be composed of heat- and flame-resistant material; however, it should still be sufficiently flexible as to not interfere with the bending of the user's finger. A small bowl 2 or other receptacle for receiving material for smoking is attached to the end of the tubing 3 at the top of the index finger, and a mouthpiece 4 to the other end after the tubing 3 is cut to its specified length.

Additionally, flap 1 may be handcrafted that will be used to cover bowl 2 at the top of the index finger. A fire-retardant material may be used for flap 1 and the index finger, and other appropriate areas may be covered with fire-retardant material. A square of fabric may be cut, folded, and attached to the edges of bowl 2 to the proper size, and then strips of Velcro® may be put down. The Velcro® is used to hold flap 1 down when bowl 2 is not in use, thereby decreasing the likeliness of foreign debris entering bowl 2 when glove 5 is not being smoked out of Strips of Velcro® are attached on glove 5 where flap 1 is to be held down. The end of flap 1 on the top of the index finger is to be permanently attached holding flap 1 when glove 5 is being used to smoke with. Additionally, a plug or other implement may be attached to the inside portion of flap 1. This plug may be sized to fit in the whole of bowl 2 and thereby plug bowl 2 when not in use to prevent the ash or other debris left in bowl 2 from releasing into the closed flap 1 area. Further, if the entire portion of tobacco or other smokable material is not completely consumed, the plug may prevent it from being lost. The plug may also be a fire prevention measure, as it will keep hot leftover ash in bowl 2. Furthermore, the plug may be used to retain smoke in the tubing and bowl subsequent to lighting the tobacco or other smoking material, especially if winds are strong.

On the back hand side of glove 5 is a small compartment with a flap 6 above that covers said compartment. This compartment holds tubing 3 as well as mouthpiece 4 that is connected to tubing 3. Once smoking has ceased, the flaps, finger, and hand are returned to the previous positions and allow the consumer to continue with their desired activity. All material that is near or potentially near to open flame when lighting bowl 2 may be made with DuPont® Nomax Fire Resistant Materials, the same material that is used to make the fire suits and gloves for NASCAR®.

In some alternatives, bowl 2 at the end of the finger of the glove is removable for cleaning purposes and may have a screw, snap, friction, or other attachment system for attaching to tubing 3. In an alternative embodiment, the position of bowl 2 and tubing 3 may be reversed, wherein the end of tubing 3 is at the finger of glove 5 and bowl 2 is at the back of the hand. Additionally, tubing 3 of glove 5 may be removable and replaceable as may be mouth piece 4. Although above Velcro® is frequently referred to as a closure mechanism, other types of closure mechanisms may be used as well, including, but not limited, to snaps, zippers, hooks, etc.

Note that foregoing examples of construction methodology are only exemplary and alternatives will occur to those skilled in the art in light of this disclosure.

Key To Drawings 1A and 1B:

Finger Flap
Bowl
Tubing
Mouth Piece
Glove
Hand Flap

While specific embodiments have been described in detail in the foregoing detailed description and illustrated in the accompanying drawings, it will be appreciated by those skilled in the art that various modifications and alternatives to those details could be developed in light of the overall teachings of the disclosure and the broad inventive concepts thereof It is understood, therefore, that the scope of this disclosure is not limited to the particular examples and implementations disclosed herein but is intended to cover modifications within the spirit and scope thereof as defined by the appended claims and any and all equivalents thereof.

We claim:

1. A smoking glove comprising:

a glove having a first opening and a second opening, the first opening located at a finger portion of the glove, the second opening distal from the first opening at a distance, the distance being at least half a length of the finger portion of the glove;

tubing, the tubing stretching from the first opening of the glove to the second opening of the glove, the tubing located within the glove; and a bowl located at a first end of the tubing.

2. The smoking glove of claim 1, wherein the first opening is at an end of the finger portion, distal from a palm of the glove.

3. The smoking glove of claim 1, wherein the second opening is at a back of a hand portion of the glove.

4. The smoking glove of claim 1, further comprising a first flap and a second flap, the first and second flaps attached to the glove and located at the first and second openings, respectively, and configured to provide for closure of the first and second openings.

5. The smoking glove of claim 4, wherein a portion of each of the first and second flaps has a closure mechanism to secure the closure of the first and second openings.

6. The smoking glove of claim 5, wherein the closure mechanism is a hook-and-loop closure mechanism.

7. The smoking glove of claim 1, further comprising a mouthpiece located at a second end of the tubing.

8. The smoking glove of claim 4, further comprising a plug, the plug attached to the first flap and sized to fit into the bowl for sealing the bowl when it is not in use.

9. The smoking glove of claim 1, wherein the first opening is at an end of the finger portion, distal from a palm of the glove and the second opening is at a back of a hand portion of the glove.

10. The smoking glove of claim 9, wherein the bowl is located at the first opening.

11. The smoking glove of claim 9, wherein the bowl is located at the second opening.

12. The smoking glove of claim 1, wherein at least a portion of the glove is made of flame-resistant material.

13. The smoking glove of claim 1, wherein the glove includes a liner and an outer portion, and the tubing is located between the liner and the outer portion.

14. The smoking glove of claim 1, wherein fire-resistant insulation is positioned proximate to the bowl and tubing.

15. A smoking glove comprising:

a glove having a first opening and a second opening, the second opening distal from the first opening at a distance, the distance being at least two inches;

tubing, the tubing stretching from the first opening of the glove to the second opening of the glove, the tubing located within the glove; and a bowl located at a first end of the tubing.

16. The smoking glove of claim 15, wherein the first opening is in a finger of the glove.

17. The smoking glove of claim 15, wherein the first opening is in a back of a hand area of the glove.

18. The smoking glove of claim 17, wherein the second opening is in a back of a hand area of the glove.

19. The smoking glove of claim 16, wherein the second opening is in a finger of the glove.

* * * * *